United States Patent [19]

Cieslak et al.

[11] 4,267,768

[45] May 19, 1981

[54] PROCESS FOR FABRICATING A RECLOSABLE BAG

[75] Inventors: Patrick J. Cieslak; Michael J. Moran, both of Sierra Madre, Calif.

[73] Assignee: David M. Cieslak, Sierra Madre, Calif. ; a part interest

[21] Appl. No.: 865,003

[22] Filed: Dec. 27, 1977

Related U.S. Application Data

[60] Division of Ser. No. 724,553, Sep. 20, 1976, abandoned, which is a continuation-in-part of Ser. No. 654,117, Feb. 2, 1976, abandoned.

[51] Int. Cl.[2] ..... B31B 1/90; B31B 49/04

[52] U.S. Cl. ..... 493/203; 493/215

[58] Field of Search ..... 93/35 DS, 33 H, 35 R, 93/8 WA; 156/515, 510; 229/65

[56] References Cited

U.S. PATENT DOCUMENTS

| | | | |
|---|---|---|---|
| 2,224,050 | 12/1940 | Hermann et al. | 229/65 X |
| 2,955,397 | 10/1960 | Heckele | 93/35 DS |
| 3,354,795 | 11/1967 | Kugler | 93/33 H |
| 3,859,895 | 1/1975 | White | 93/35 DS |
| 3,889,871 | 6/1975 | White | 229/65 |

FOREIGN PATENT DOCUMENTS

| | | | |
|---|---|---|---|
| 1221819 | 6/1960 | France | 229/65 |

*Primary Examiner*—James F. Coan

*Attorney, Agent, or Firm*—Christie, Parker & Hale

[57] ABSTRACT

A reclosable bag utilizing one or more inelastic strands of material secured in spaced apart relation to the walls of the bag over a part or the entire length of the bag. To close the bag, the strand is wound or twisted about the bag at a point intermediate the open end of the bag and its contents to thereby achieve closure.

3 Claims, 15 Drawing Figures

Fig. 1
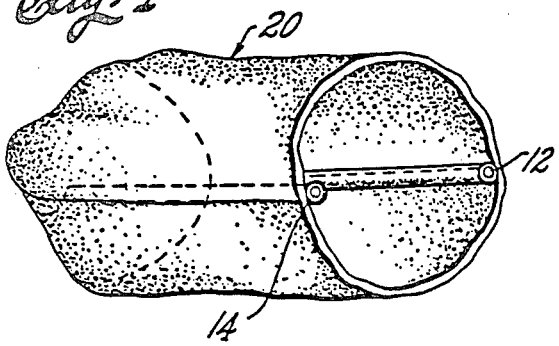
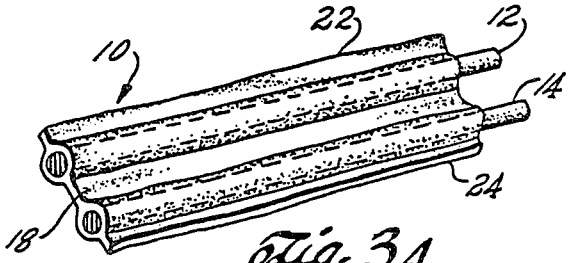
Fig. 3A
Fig. 2
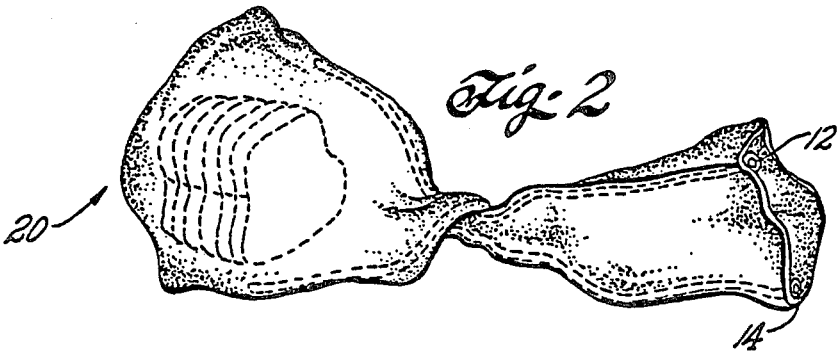
Fig. 4
Fig. 3B
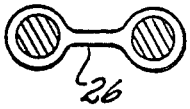
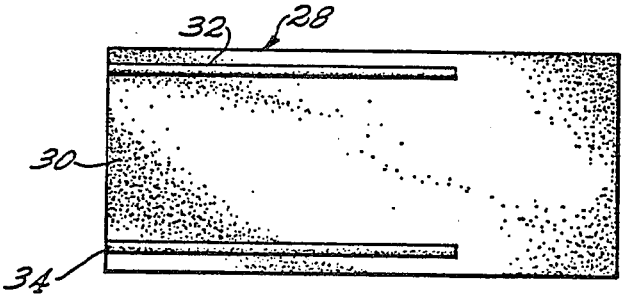
Fig. 5A
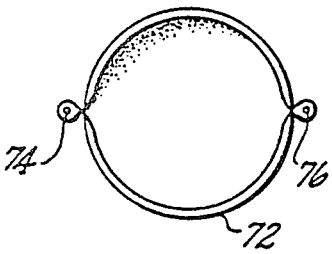
Fig. 5B
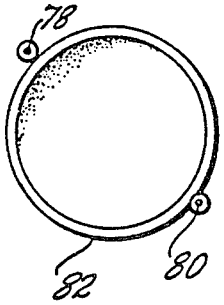
Fig. 5C
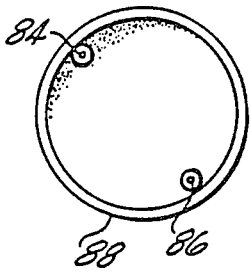
Fig. 5D
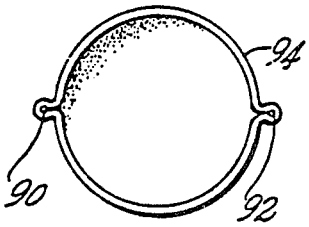

PROCESS FOR FABRICATING A RECLOSABLE BAG

CROSS REFERENCE TO RELATED APPLICATIONS

This is a division of application Ser. No. 724,553, filed Sept. 20, 1976, and now abandoned, which is a continuation-in-part of our application filed on Feb. 2, 1976, Ser. No. 654,117, and now abandoned.

BACKGROUND OF THE INVENTION

This invention relates to reclosable bags and in particular to plastic bags having a closure mechanism incorporated into the structure of the bag.

DESCRIPTION OF THE PRIOR ART

In the packaging of food and other perishable items a plastic bag is frequently used. Such bags are normally fabricated from a sheet of thermoplastic material or are extruded and when so fabricated have a "memory" which tends to cause them to retain the shape which they were given upon fabrication. When utilizing such bags for packaging food products after the package has been opened, it is desirable to provide some means of reclosure to maintain freshness of the contents.

Among the several ways in which bag reclosure has been accomplished in the past is to fold or twist the bag upon itself. Without the provision of external means, such as a clip to maintain the bag in the closed position, the tendency of the material is to return to its original shape, causing the bag to open and thereby expose the contents to air and spoilage.

The most typical way in which bag closure is attempted is by external mechanical means such as a tab or twist-tie. The tab has a slot on one edge whereby the bag material can be gathered and the slot is force-fitted over the gathered material to pinch and hold same in a central keyhole aperture. A twist-tie is a separate short length of wire usually secured between plastic or paper strip laminations. This tie is twisted about the gathered bag material creating a close neck of bag material. The disadvantage of either tab or twist-tie is that each is a separate element and subject to misplacing or loss, with the result that the mechanism for sealing the bag is lost. Another difficulty is the inherent time and difficulty involved in handling a separate item from the bag in the opening and closing manipulations.

Attempts have been made to provide means which are integral with the package or bag to achieve closure. These efforts are described and illustrated in the following U.S. Patents:

| U.S. Pat. No. | Invention Title | Inventor |
|---|---|---|
| 3,321,126 | Reclosable Container | Rivman, et al |
| 3,537,636 | Reclosable Package | Rochette |
| 3,201,030 | Container | Pollack |
| 3,099,384 | Bag Closure | Baxter |
| 3,353,662 | Plastic Bags with Metal Foil Laminated Lips | Pickin |
| 3,618,850 | Reclosable Container | Palmer |
| 907,492 | Bag | Gaser |
| 3,402,052 | Openable and Reclosable Container | Walker |
| 651,937 | Bag Fastener | Short |
| 3,754,371 | Method and Apparatus for Closing the Mouths of Flexible Containers by Twisting | Walker III |

-continued

| U.S. Pat. No. | Invention Title | Inventor |
|---|---|---|
| 3,889,871 | Reclosable Flexible Bag | White |

With respect to the foregoing patents, the bags or containers illustrated therein utilize one or more wires or foil strips laminated in one wall of the enclosure and with the exception of Walker and Short each requires that the wall be crimped or folded to achieve closure. More importantly, the elaborate laminations and multiplicity of closure elements make such approaches uneconomical to fabricate and are believed to be the reason why none have been successful in a commercial sense for use in enclosing everyday staples such as bread, vegetables and the like. In the case of Short the wires are secured to the outside of a paper container by paper or cloth tape requiring either labor intensive hand fabrication, or at least one additional station in a production line setup. Walker provides a significant number of foil strips, normally six or more, which are adhesively secured to the exterior surface of bag material. Here again, the choice of materials and structure make the bag uneconomical to utilize because of the inherent cost of materials used and the number of manufacturing steps involved.

SUMMARY OF THE PRESENT INVENTION

The present invention avoids the difficulties and inconveniences characteristic of the containers and bags described above and provides instead a bag enclosure with integral closing mechanism that is easily incorporated into the internal or external walls of the bag in a manner that requires only a minor modification of the conventional bag fabricating machinery. The invention provides a closure which is preferably a pair of thin aluminum wires, encapsulated in thermoplastic and securing at opposite sides of a thermoplastic enclosure by heat sealing providing a bag and an integral closure, competitive in cost to bage with separate closure mechanisms and which is characterized by ease of fabrication and use and high reliability as a bag closing mechanism.

In one aspect, the invention provides a reclosable bag comprising a flexible thermoplastic bag enclosure having an open end and a closed end. A first strand of a bendable inelastic material encapsulated in a thermoplastic material is secured to a longitudinal wall of the enclosure, the strand extending longitudinally of the enclosure and being heat-sealed thereto. A second strand of a bendable inelastic material is secured to a longitudinal wall of the enclosure opposite the first strand, the second strand extending longitudinally of the enclosure and being heat-sealed thereto such that the first and second strand are spaced apart a sufficient distance whereby all wall material at a given point along the length of the bag can be gathered and twisted with the strands to obtain closure of the bag.

In another aspect, the invention provides a process for fabricating a reclosable bag comprising the steps of passing a pair of superimposed layers of sheet material formed by longitudinally folding a single sheet of thermoplastic material along a defined path to a cutting and sealing station. A length of a cable comprising a pair of strands of bendable inelastic material encapsulated in thermoplastic cable material is positioned longitudinally of the bag at a point straddling a line of separation of one bag from an adjacent bag. The layers of thermoplastic material are separated into separate and individual bags by cutting and sealing the superimposed sheets of thermoplastic material and cutting and sealing the cable of encapsulated inelastic strands to the walls of the bag by simultaneously cutting and sealing the cable between the adjacent strands of inelastic material to secure the strands to the walls of the bags.

The advantage of such a design and method is the provision of a closing mechanism which is integral with the bag and which can be incorporated into the bag simply and economically as one of the steps in conventional fabrication of the bag. A positive closure is attained by having two wires available which are twisted with each other. In addition, by the present invention the bag can be resealed at any point along its length. The bag remains firmly closed and the closure mechanism is not weakened by reuse because the bag is closed at different points along its length.

A further advantage is provided by the plastic coating on the closure wires. A major criticism of paper-coated twist-ties has been that consumers often prick their fingers on the exposed wire at the end of the tie. The plastic coating on the wires of the present invention and their incorporation into the structure of the bag reduces this hazard.

DESCRIPTION OF THE DRAWINGS

These and other advantages of the present invention will be better understood by reference to the figures of the drawing wherein:

FIG. 1 is a perspective view of a flexible bag, the wire closure strands incorporated into the interior of the bag along the side seams thereof;

FIG. 2 is a perspective view of the bag of FIG. 1 with the contents partially removed and the twist closure accomplished;

FIG. 3A is a perspective view of a coaxial cable type of construction comprising plastic encapsulating two parallel spaced apart wires for attachment to the bag during fabrication.

FIG. 3B is an alternate embodiment of the coaxial cable of FIG. 3;

FIG. 4 is a plan view of the length of a flexible bag material having a pair of strands of thermoplastic coated inelastic bendable material secured thereto by laminating preheated strands onto the walls of the plastic bag material;

FIG. 5A is a view in section of an embodiment of bag material having a pair of inelastic strands secured to the exterior walls of the bag material by the same method as utilized to fabricate the bags illustrated by FIGS. 1 and 2;

FIG. 5B is another embodiment bag material wherein the plastic strands are secured to the bag by laminating same to the outside of the bag near seams;

FIG. 5C is an alternate embodiment of the bag of FIG. 5B wherein the wires are laminated to the bag interior;

FIG. 5D is another alternate embodiment of the bag of the present invention wherein the inelastic strands are secured to the bag by double-seaming the bag along the line of attachment of the wires;

DESCRIPTION OF A SPECIFIC EMBODIMENT

Figure 6A:
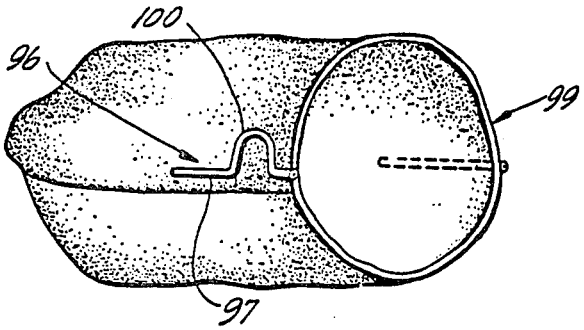
FIG. 6A is a perspective view of an alternate form of the enclosure of the present invention utilizing a closure strand in the form of a loop.

In the construction of bags and flexible containers for perishable items such as bread, vegetables and the like, the typical procedure is to use a sheet of a plastic material such as polyethylene. The sheet is dimensioned such that it can be folded longitudinally and cut periodically. The cut transverse edges are joined together edgewise to define a tube having an open end and a closed end as a first step in creating a bag enclosure. Such a process of fabrication as illustrated in U.S. Pat. No. 3,889,871.

As is discussed in more detail with respect to subsequent figures of the appoication, while closure strands can be applied to the bag wall by a number of different methods, the object is to provide a plastic bag that is capable of being closed without an additional separate element and to secure the closure strands so that they are held in position while the bag is being fabricated.

Flexible thermoplastic sheet bags are commonly produced by folding a single, continuous sheet of thermoplastic sheet meterial longitudinally to form two superimposed layers. The two layers travel along a specific path to a station where the layers are cut transversely to the direction of motion of the layers and sealed by a vertically moving hot knife. The hot knife descends to cut and seal the material, forming a side seam. When the knife is lifted, the material is moved a predetermined distance. The hot knife descends again to form the opposite side seam, thereby producing a bag. The open end of the bag is left unsealed for the insertion of the contents into the bag.

In the preferred embodiment of the present invention as shown in FIGS. 1, 2, and 3, a length of prefabricated cable 10 comprised of two or more parallel strands of inelastic material 12, 14, preferably thin aluminum wire, coated with a suitable thermoplastic or hot melt material 16 such as polyethylene, and connected together by a thin webbing 18 of the coating material is placed longitudinally of the bag adjacent the cutting line of the hot knife. When the hot knife descends to form a side seam, the parallel strands of inelastic material are positioned such that the knife falls between the strands bonding one strand to the trailing seam of the first bag, and at the same time, the other strand to the leading seam of the next bag. The result is a bag 20 with a closure wire 12 incorporated into one side seam along the interior of the bag and a second closure wire 14 incorporated into the opposite side seam of the bag along its interior.

As shown in FIG. 2, when the bag is partially empty, closure is obtained by twisting the walls of the bag adjacent the remaining contents 23 causing wire 12 to be twisted about wire 14. Because the wire is bendable and inelastic, the wires intertwine to close and hold the upper portion of the bag in the twisted position preventing it from returning to the open position shown in FIG.

1. Locating wires 12, 14 in a spaced apart relation such as the side walls of the bag enable the bag material to be gathered with and between the wires and be intertwined therewith when the wires are twisted together.

The coaxial cable 10 of closure wires is shown in alternate embodiments in FIGS. 3A and 3B. In FIG. 3A, the cable has flanges 22, 24 at each side in those applications where the mechanism for applying the cable to the bag requires means for gripping the sides of the cable. Providing flanges on the cable also enables the use of an alternate manufacturing approach for incorporating closure strands into a reclosable bag. In this alternate approach the flanges 22, 24 of the cable are sealed to the polyethylene bag material prior to the cutting step when the polyethylene is separated into individual bags. The embodiment of the cable 26 shown in FIG. 3B is fabricated without flanges and is suitable for use with an insertion mechanism such as shown in FIG. 8.

A reclosable bag 28 according to the present invention is illustrated in one stage of fabrication in FIG. 4. As shown therein, the bag comprises a length of a thermoplastic material 30 to which have been applied a pair of closure wires 32, 24 encapsulated in or coated with a thermoplastic material preferably the same as the material of the bag 30. Such wires are applied to the bag by passing the wires through or past an induction coil or by directing electric current through the wire to heat and soften the thermoplastic coating on the wires. Thereafter, the wires are dropped into position on the bag material adjacent the outside edges thereof. Thereafter, the sheet material proceeds to the cutting and sealing station to be cut and sealed in the normal fashion to provide the reclosable bag.

Figure 8:
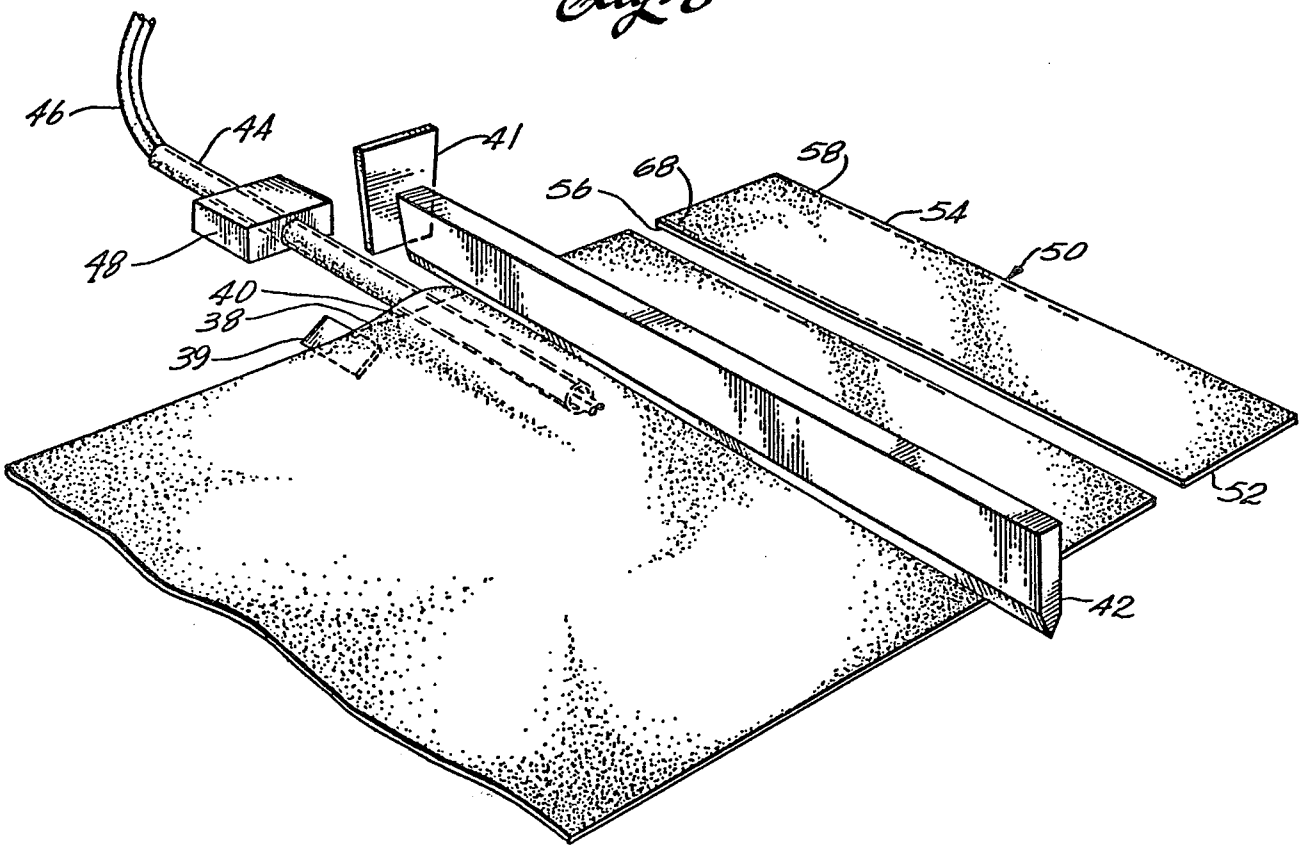
FIG. 8 is a schematic view in perspective of the preferred embodiment of the method of attachment of the closure wires to produce the reclosable bag of the present invention.

FIG. 8 illustrates the preferred embodiment of the method of attachment of the closure wires to the reclosable bag of the present invention. As shown therein, two superimposed layers of thermoplastic sheet material 38 and 40 move along a production line and are brought into position beneath a hot knife 42. The hot knife periodically descends to cut the thermoplastic sheet material and to heat-laminate the sides together to produce the individual bags. A shoe 39 is located along the line of travel of the thermoplastic bag material prior to the cutting state. Shoe 39 is positioned so as to extend between layers 38, 40 of the thermoplastic sheet material. The shoe is angularly oriented to provide a spacing between layers 38, 40. Prior to the cutting step with the hot knife an inserter tube 44 through which is threaded the coaxial cable 46 containing the closure wires according to the present invention is advanced by means of a solenoid 48 into the spacing between the layers 38, 40 of the thermoplastic sheet material. The insertion of the cable is at a position directly along the cutting line of the hot knife such that upon descent of the hot knife it cuts the webbing between the wires of the coaxial cable and heat-laminates the webbing into the seam of the bag as the sheets of thermoplastic material are severed and laminated. Simultaneous with the descent of the hot knife, a wire cutter 41 moves downwardly to sever the cable and closure wires. The result is a bag 50 having a closed end 52, two heat-sealed side seams 54, 56, in which are also sealed wires 58, 60. The open end of the bag is located at 70.

Such a fabrication method results in a bag also illustrated in FIGS. 1 and 2 of the application. As an alternate embodiment to the present invention, a bag having wires secured to the outside is shown in FIG. 5A. In this embodiment the apparatus shown in FIG. 8 can be used to accomplish the fabrication of the bag. In this instance the cable is overlaid on top of the thermoplastic sheet material and the hot knife descends severing the two halves of the coaxial cable. In the severing operation, again, the webbing and the sides of the bag are heat-laminated together, resulting in a bag 72 having wire encapsulated closure wires 74 and 76 disposed along the exterior of the bag at the seams thereof. FIG. 5B is an illustration of the application of the closure wires to the exterior of the bag according to the same method utilized in conjunction with the attachment of wires to the bag in FIG. 4, a method of attachment which can be referred to as the "hot drop" attachment method. Again, the wires are heated by a suitable mechanism and the plastic encapsulated wires 78, 80 are attached by lamination to the exterior of the bag 82. The embodiment of FIG. 5C is similar to the embodiment of FIG. 5B with the difference that the closure wires 84, 86 are attached to the interior of the bag 88. Finally, in FIG. 5D two uncoated wires 90, 92 placed between the layers of thermoplastic material in the manner described in FIG. 8 and are contained within pockets created in the walls of the bag 94. The pockets are created by the utilization of a specially designed hot knife which is constructed so that it seals and cuts the thermoplastic material along the side seam between the two wires and at the same time heats and seals the opposite layers of thermoplastic material to laminate the layers of sheet material together along the opposite sides of the wires, thereby forming the pocket which holds the wires in position along the newly formed side seam. A separate hot knife may also be used to form the inner edge or seam of the pocket.

Figure 6B:
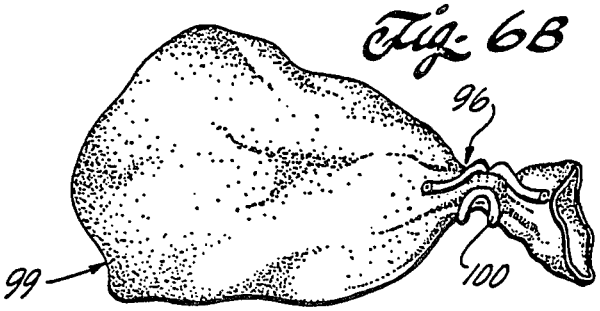
FIG. 6B is a perspective view of the enclosure of FIG. 6A in the closed position.

An alternate embodiment of the present invention utilizing a single strand 96 of a thermoplastic coated wire is shown in FIGS. 6A and 6B, having a loop 98 formed in the strand 96 of inelastic material. The loop is formed by bending the inelastic material over or partly around a cam activated bar caused to bear transversely against a length of the strand. The loop is formed and thereafter positioned close to the open end portion of the bag after the fabrication steps for the bag 99 are completed. At the time the wire is secured in position, the loop portion 100 is bent away out of contact with the bag so that straight portion 97 is the portion secured to bag 99. In the desired usage of the bag, the bag's top is twisted and the loop secured around the twisted portion by a further twisting action in the same direction as shown in FIG. 6B. This causes the bag's opening to remain tightly secured.

Figure 7A:
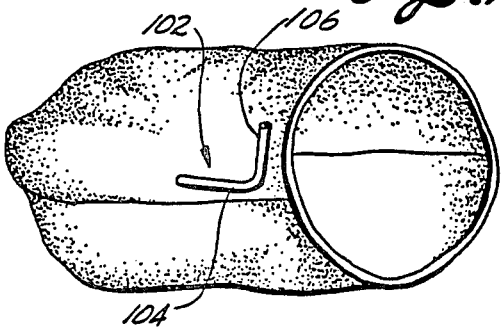
FIG. 7A is a perspective view of still another alternate form of the enclosure of the present invention utilizing an "L" shaped closure strand.
Figure 7B:
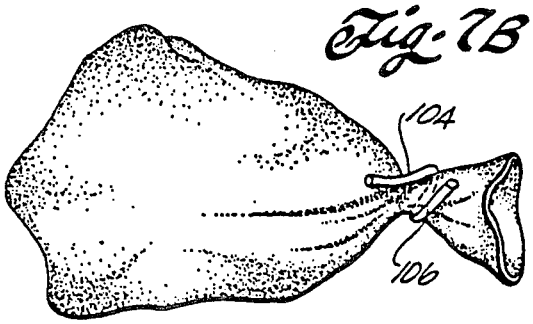
FIG. 7B is a perspective view of the enclosure of FIG. 7A in the closed position.

Still another embodiment of the present invention provides a thermoplastic coated, inelastic wire 102 formed in the shape of an "L" as shown in FIGS. 7A and 7B. The wire is heated by passing a current through it until the coating becomes adhesive. The "L" shaped wire 102 is then positioned near the opening of the bag with the foot 104 of the "L" adhering to the thermoplastic sheet material of the bag, while the upright body portion 106 of the "L" remains unattached. As in FIG. 6B, the inelastic "L" shaped wire is wound around the gathered open end of the bag as shown in FIG. 7B. The "L" shaped wire could also be adhesively bonded to the sheet. Other shapes of closure are also contemplated by the invention, including an unmodified straight length of wire.

Figure 9:
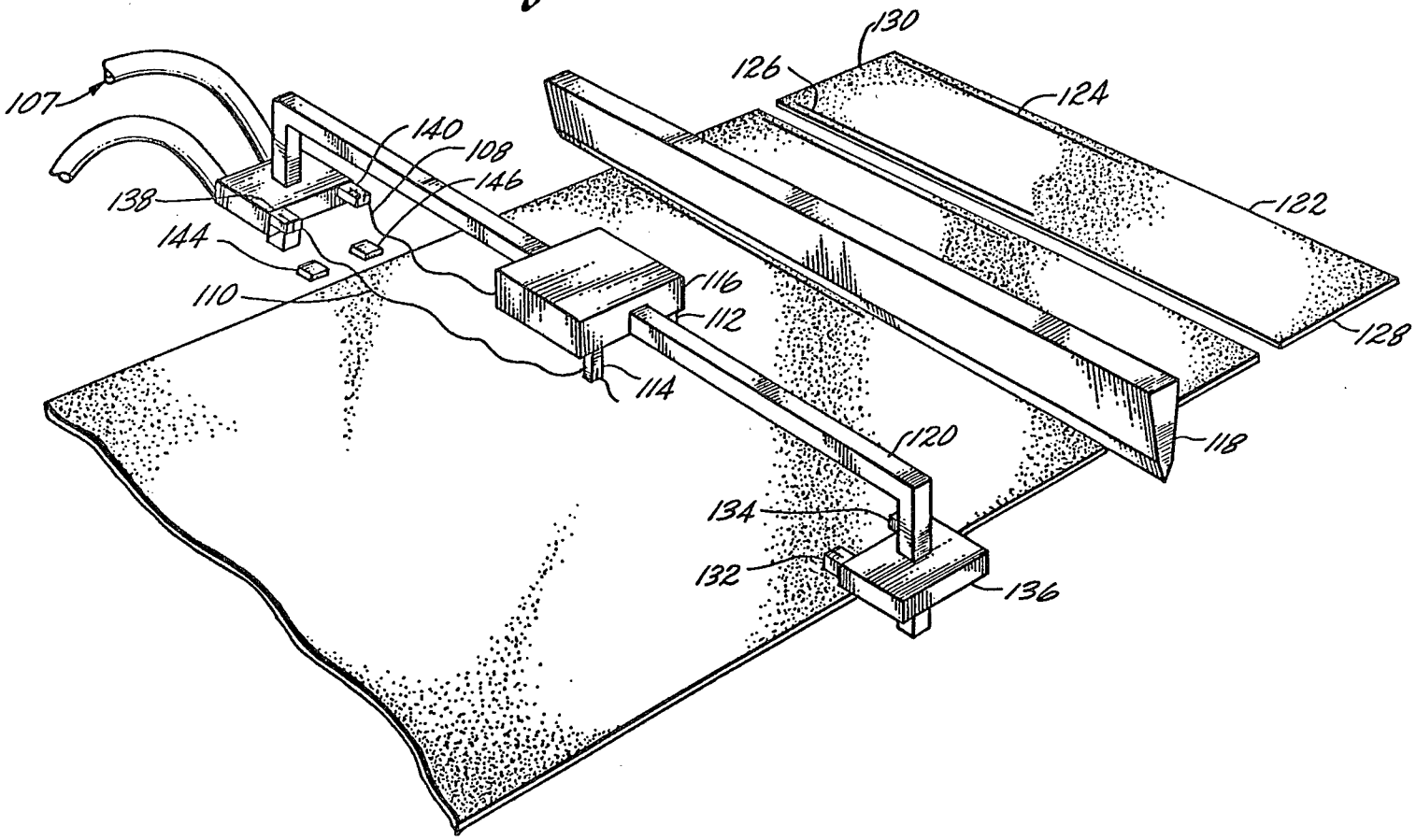
FIG. 9 is a schematic view in perspective of an alternate embodiment of the method of attachment of the closure wires to produce the reclosable bag of the present invention.

The method of attaching the thermoplastic coated wires to the bag material by placing heated wires on the walls of the bag is illustrated in FIG. 9. As shown therein, a pair of wires 108, 110 are grasped and carried away from a source of supply by means of grippers 112, 114 dependent from a solenoid 116 longitudinally along the extent of the bag material at a station located just prior to the location of a hot knife 118. Prior to the solenoid 116 completing its traverse on support 120, the wires are heated by passing electric current therethrough or by drawing the wires through or past an induction coil, softening the coating thereon.

When the solenoid 116 completes its traverse on support 120, fingers or grippers 132, 134 on a second solenoid 136 grasp wires 108, 110 at one end and fingers 138, 140 on solenoid 142 grasp the wires at the opposite end adjacent the source of supply. Grippers 112, 114 release and solenoids 136, 142 are activated and move down positioning wires 108,110 against the thermoplastic material. In the downward stroke of the solenoids, the wires are severed at cutting stations 144, 146. The heated wires are thereby heat-laminated to the bag wall and seamed into the bag itself. Fingers 132, 134, 138, 140 release and the bag material then moves into position beneath the hot knife 118 such that the knife descends between wires 108 and 110 to cut and heat-seal the sides of the bag. The result is an enclosure 122 having wires 124 and 126 attached to the outside of the bag. The bag is closed at 128 and open at 130.

What is claimed is:

1. A process for fabricating a recloseable bag comprising the steps of:

(1) passing a pair of superimposed layers of sheet material formed by longitudinally folding a single sheet of thermoplastic material along a defined path to a cutting and sealing station;

(2) positioning a length of cable comprising a pair of spaced apart strands of bendable inelastic material encapsulated in thermoplastic cable material longitudinally of the bag at a point straddling a line of separation of one bag from an adjacent bag and (3) separating the layers of thermoplastic material into separate and individual bags by cutting and sealing the superimposed sheets of thermoplastic material and the cable of thermoplastic material along a line between the pair of inelastic strands to bond the sheets of thermoplastic material to each other and to the thermoplastic cable material to define the sealed side edges of the bag and to secure a strand of inelastic material along each side edge of the bag in at least one encapsulating layer of thermoplastic material.

2. A process according to claim 1 wherein the positioning step comprises the step of inserting the cable between the pair of superimposed layers of sheet material.

3. A process according to claim 1 wherein the positioning step comprises the step of placing the cable on one of the exterior sides of the superimposed layers of sheet material.

* * * * *